US006771180B2

(12) United States Patent
Mizuta et al.

(10) Patent No.: US 6,771,180 B2
(45) Date of Patent: Aug. 3, 2004

(54) BILL RECEIVING/PROCESSING MACHINE

(75) Inventors: Yoshiomi Mizuta, Himeji (JP); Hajime Morino, Himeji (JP)

(73) Assignee: Glory Ltd., Hyogo (JP)

( * ) Notice: Subject to any disclaimer, the term of this patent is extended or adjusted under 35 U.S.C. 154(b) by 36 days.

(21) Appl. No.: 09/932,168

(22) Filed: Aug. 17, 2001

(65) Prior Publication Data

US 2002/0043443 A1 Apr. 18, 2002

(30) Foreign Application Priority Data

Aug. 30, 2000 (JP) ..... 2000-260703

(51) Int. Cl.[7] ..... G08B 21/00

(52) U.S. Cl. ..... 340/674; 194/200; 235/379; 209/534

(58) Field of Search ..... 340/674; 705/35, 705/39, 45; 209/534, 546, 549, 551; 235/379, 454; 194/200; 377/6

(56) References Cited

U.S. PATENT DOCUMENTS 4,694,963 A * 9/1987 Takesako ..... 209/534
4,747,492 A 5/1988 Saito et al. ..... 209/534
4,830,742 A 5/1989 Takesako
5,917,930 A 6/1999 Kayani et al.
5,966,456 A 10/1999 Jones et al.
6,012,589 A 1/2000 Schulze

OTHER PUBLICATIONS

Copy of European Search Report.

* cited by examiner

*Primary Examiner*—Thomas Mullen
(74) *Attorney, Agent, or Firm*—TraskBritt

(57) ABSTRACT

The present invention provides a bill receiving/processing machine, which has a simple configuration having no temporary reserving section, and has no need of manually sorting the approved bills even in the case where a fault is generated, and can rationally carry out cancel processing with respect to a transaction such that a bill has been already sent to a stacker after money denomination discriminating/counting handling is completed. The bill receiving/processing machine includes: a fault detection apparatus for detecting a generation of fault in money receipt transaction after second time excluding the first time transaction; an alarm for giving an alarm such that a fault is detected by the fault detection means; and a fault recovery processing section which again places the bill on the hopper when the alarm gives the alarm of a generation of fault, receives the total bill adding a bill of the present money receipt transaction and a approved bill before the money receipt transaction in the stacker in accordance with the money denomination, and distinguishes a received money data of the present money receipt transaction from a received money data of the previous money receipt transaction.

8 Claims, 7 Drawing Sheets

RECEIVED MONEY
STATEMENT
OF BRANCH A

| | |
|---|---|
| 1 $: | 15 SHEETS |
| 2$: | 20 SHEETS |
| 5$: | 10 SHEETS |
| 10$: | 5 SHEETS |
| 20$: | 30 SHEETS |
| 50$: | 25 SHEETS |
| 100$: | 40 SHEETS |

FIG. 8A

RECEIVED MONEY
STATEMENT
OF BRANCH B

| | |
|---|---|
| 1 $: | 20 SHEETS |
| 2$: | 25 SHEETS |
| 5$: | 30 SHEETS |
| 10$: | 40 SHEETS |
| 20$: | 10 SHEETS |
| 50$: | 20 SHEETS |
| 100$: | 30 SHEETS |

FIG. 8B

RECEIVED MONEY
STATEMENT
OF BRANCH C

| | |
|---|---|
| 1 $: | 20 SHEETS |
| 2$: | 35 SHEETS |
| 5$: | 50 SHEETS |
| 10$: | 10 SHEETS |
| 20$: | 40 SHEETS |
| 50$: | 30 SHEETS |
| 100$: | 50 SHEETS |

FIG. 8C

BILL RECEIVING/PROCESSING MACHINE

BACKGROUND OF THE INVENTION

1. Field of the Invention

The present invention relates to a bill receiving/processing machine, which discriminates a denomination of bill (paper money or bank note) at every money receipt transaction, counts the number of received bills, and further receives them in a stacker for each kind of bill. In particular, the present invention relates to a bill receiving/processing machine, which has a simple structure having no temporary reserving section for temporarily reserving the bill before receiving, and securely performs bill receiving/processing for a plurality of transactions even in the case where a fault such as bill jam happens, and rationally performs a cancel processing with respect to a transaction completing a bill kind discriminating/counting process.

2. Description of the Prior Art

In the bill receiving/processing machine, in general, a temporary reserving section has been mainly employed. The temporary reserving section temporarily reserves the received bill (paper money or bank note) in a temporarily reserving section before receiving, and thereafter, receives it in a stacker after confirming the final transaction. There is a bill receiving/processing machine (note sorting and counting apparatus) disclosed in the U.S. Pat. No. 4,747,492 by the present applicant, which has the above mentioned temporary reserving section. The apparatus disclosed in the above U.S. Patent includes stackers (S1 to S6) for receiving the bill for each kind. These stackers (S1 to S6) are respectively provided with temporary reserving sections (SH1 to SH6) at their upper portions.

Continuous processing by the above apparatus to a plurality of bill receipt transactions is made in the following manner.

First, when a received bill of the first transaction is put into a hopper, the bill fed from the hopper is discriminated for each money kind by a money kind discriminating section. Thereafter, the bill is fed to the temporary reserving sections (SH1 to SH6) positioned on the upper portion of the money kind stackers (S1 to S6) in accordance with a denomination of the bill. Subsequently, a received money statement and the processing result by the present apparatus are collated, and when the collation is correct, a received money confirmation button is pushed, and thereby the bill is released from the temporary reserving sections (SH1 to SH6), and then, is successively received in the stackers (S1 to S6). A received money transaction after the second time is processed in the same manner as above. For example, if a fault such as a jam happens during the second time received money transaction, only bill of the second time transaction exists in the temporary reserving sections (SH1 to SH6); therefore the bill of the first time transaction is not mixed therein.

After all, when a fault happens in the apparatus, an operator may carry out fault recovery handling for collecting the bills reserved in the temporary reserving sections (SH1 to SH6), the bill(s) remaining in the hopper and the bill(s) existing in the feeding passage having the jam, and again putting them in the hopper.

On the other hand, in order to reduce a price of the apparatus, there appear many bill receiving/processing machines having a simple configuration including no temporary reserving section. In the bill receiving/processing machine having no temporary reserving section, a plurality of money receipt transactions are continuously processed, and then, in the case where a fault such as a jam is generated during processing after the second time transaction, the fault recovery process is troublesome. For example, the first time money receipt transaction is normally processed, and thereafter a fault such as a jam is generated during the second time transaction processing. In this case, in view of the bills received in each stacker, the bills of the approved first time transaction are mixed with the bills of the disapproval and processing second time transaction. In order to recover this state, the following work is required. The mixed bills are all taken out of each stacker, and the bills remaining in the hopper and the bills on the feed passage causing the jam are collected and further, the operator manually counts the number of bills by so as to sort the bills of the approved first transaction.

For this reason, in the bill receiving/processing machine having no temporary reserving section, when a fault is generated, the recovery work of machine becomes very troublesome; as a result, there is a possibility of causing erroneous handling.

As described above, in the bill receiving/processing machine, when a plurality of money receipt transactions are continuously processed, a fault is generated. In order to speedily nd accurately carry out the recovery processing, it is effective to provide a temporary reserving section. However, in the case where the temporary reserving section is provided, a problem arises such that the machine structure becomes complicated, and the machine cost increases.

Further, in order to reduce the price of the machine, in the bill receiving/processing machine having no temporary reserving section, in the case where a fault such as a jam or the like is generated, the recovery processing becomes very troublesome; as a result, a problem arises such that there is a possibility of causing erroneous processing.

SUMMARY OF THE INVENTION

The present invention has been made in view of the above problems in the prior art. Accordingly, an object of the present invention is to provide a bill receiving/processing machine, which can achieve a price reduction by a simple configuration having no temporary reserving section, and has no need of manually sorting approved bills even in the case where a fault such as a jam is generated.

Further, another object of the present invention is to provide a bill receiving/processing machine, which can rationally carry out cancel process with respect to a transaction such that a bill has been already sent to a stacker after money denomination discriminating/counting process is completed.

The present invention relates to a bill receiving/processing machine, which separately feeds a bill placed on a hopper one by one in succession of every money receipt transaction, supplies the bill to money denomination discriminating/counting means discriminating a denomination of the bills and counting the number of bills, receives the bills sorted by the money denomination discriminating/counting means in a stacker in accordance with the money denomination, and has no temporary reserving section for temporarily separating the bills from the stacker when the bills are received in the stacker for each money denomination. The above object of the present invention can be achieved by providing: a fault detection means for detecting a generation of fault in a money receipt transaction after a second time exclusion of the first time transaction; alarm means for giving an alarm when a fault is detected by the fault detection means; and a fault recovery handling section which again places the paper money on the hopper when the alarm means gives the alarm of a generation of fault, means for receiving the total bills adding a bill of the present money receipt transaction and an approved bill before the money receipt transaction in the stacker in accordance with the money denomination, and means for distinguishing received money data of the present money receipt transaction from received money data of the previous money receipt transaction.

Further, the above object of the present invention can be achieved by providing a control section which collects a bill relative to the transaction received in the stacker by the money denomination discriminating/counting means and an approved bill already received in the stacker before the money receipt transaction, and again places the collected bill on the hopper so that money denomination discriminating/counting is again carried out in the case where when a plurality of money receipt transactions is continuously carried out, the transaction after the second time excluding the first time transaction is cancelled after money denomination discriminating/counting is completed, receives the bills in the stacker by the number of bills when the money receipt transaction before the transaction is approved, and discharges the bill after that to the reject stacker.

BRIEF DESCRIPTION OF THE DRAWINGS

In the accompanying drawings:

FIGS. 8A to 8C are views showing an embodiment of a cash statement slip sent from each branch of a bank.

DESCRIPTION OF THE PREFERRED EMBODIMENTS

A bill receiving/processing machine of the present invention will be described below with reference to the accompanying drawings.

Figure 1:
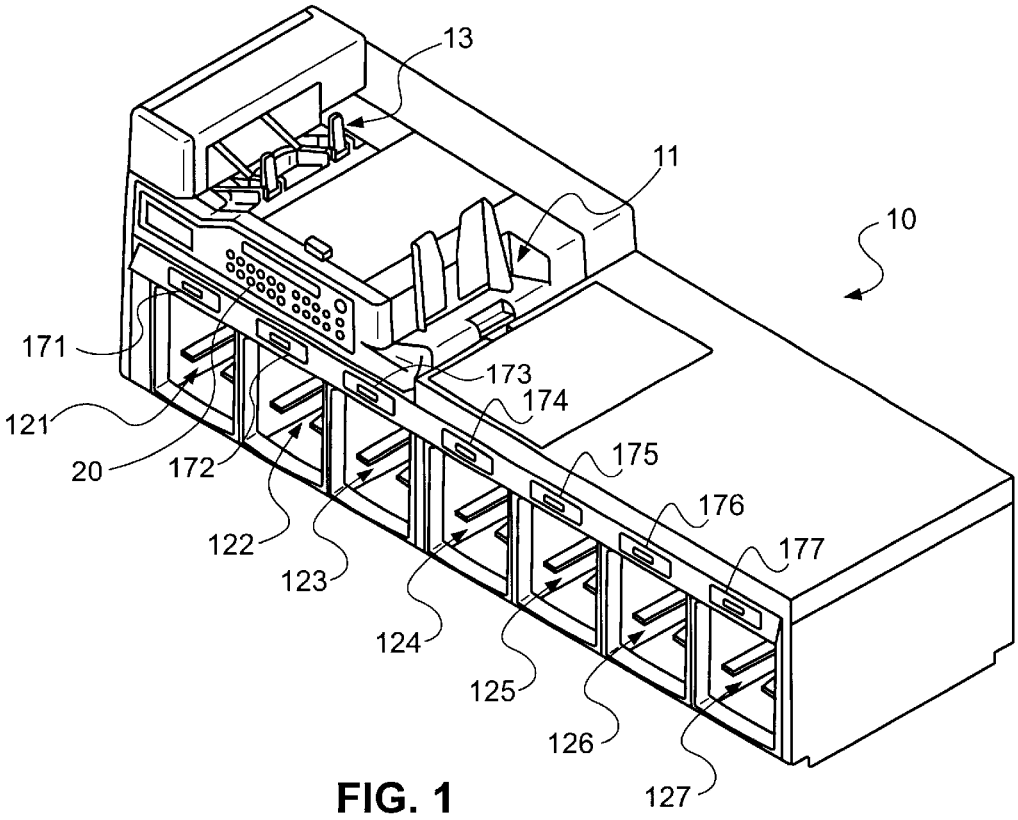
FIG. 1 is a perspective view showing an embodiment of a bill receiving/processing machine according to the present invention.

FIG. 1 is a perspective view showing an appearance of a bill receiving/processing machine 10 of the present invention. In the bill receiving/processing machine 10, a housing main body is provided with a hopper 11 placing a bill for money receipt processing, at its upper portion, and a front panel is provided with a display/operation section 20 for displaying a necessary data and for inputting instructions for the process. Further, the main body is provided with partitioned stackers 121 to 127 for receiving discriminated bill for each money denomination at its lower portion, and is provided with a reject stacker 13 for discharging and collecting a rejected bill at the end portion on its upper portion. The stacker LEDs 171 to 177 for displaying the number of received bills are provided so as to correspond to the stackers 121 to 127 at upper portions of these stackers. The stacker LEDs 171 to 177 make continuous lighting display or flashing display. The stackers 121 to 127 have a structure which permits a manual retrieval of the received bill from the outside of the structure.

Figure 2:
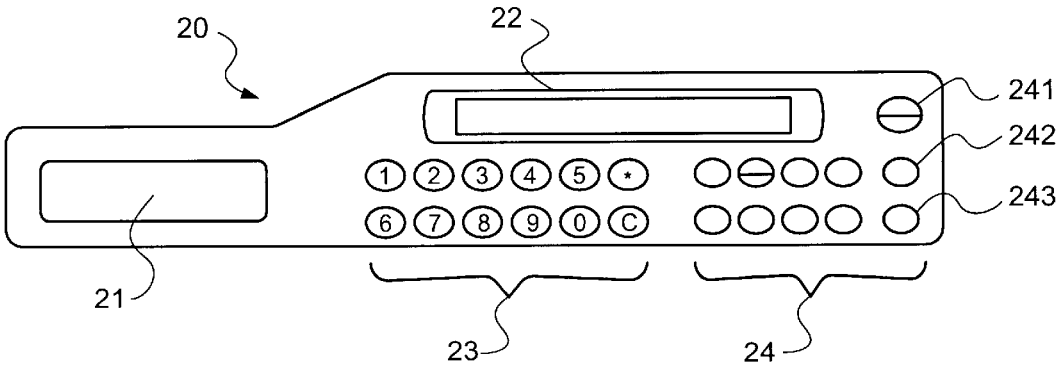
FIG. 2 is a view showing an embodiment of a display/operation section.

FIG. 2 shows the details of the display/operation section 20. The display/operation section 20 is composed of a liquid crystal display section 21 for displaying time and error code or the like, a LED display section 22 comprising a LED for displaying money denomination discrimination and count data, a ten key device 23 for inputting a numerical data and an operation key 24 for making an operating instruction. The operation key 24 includes a "START/STOP" key 241 for giving an instruction to start and stop the operation, a "CLEAR" key 242 for giving an instruction to clear a data and an "ACCEPT" key 243 for giving an instruction to accept an input.

Figure 3:
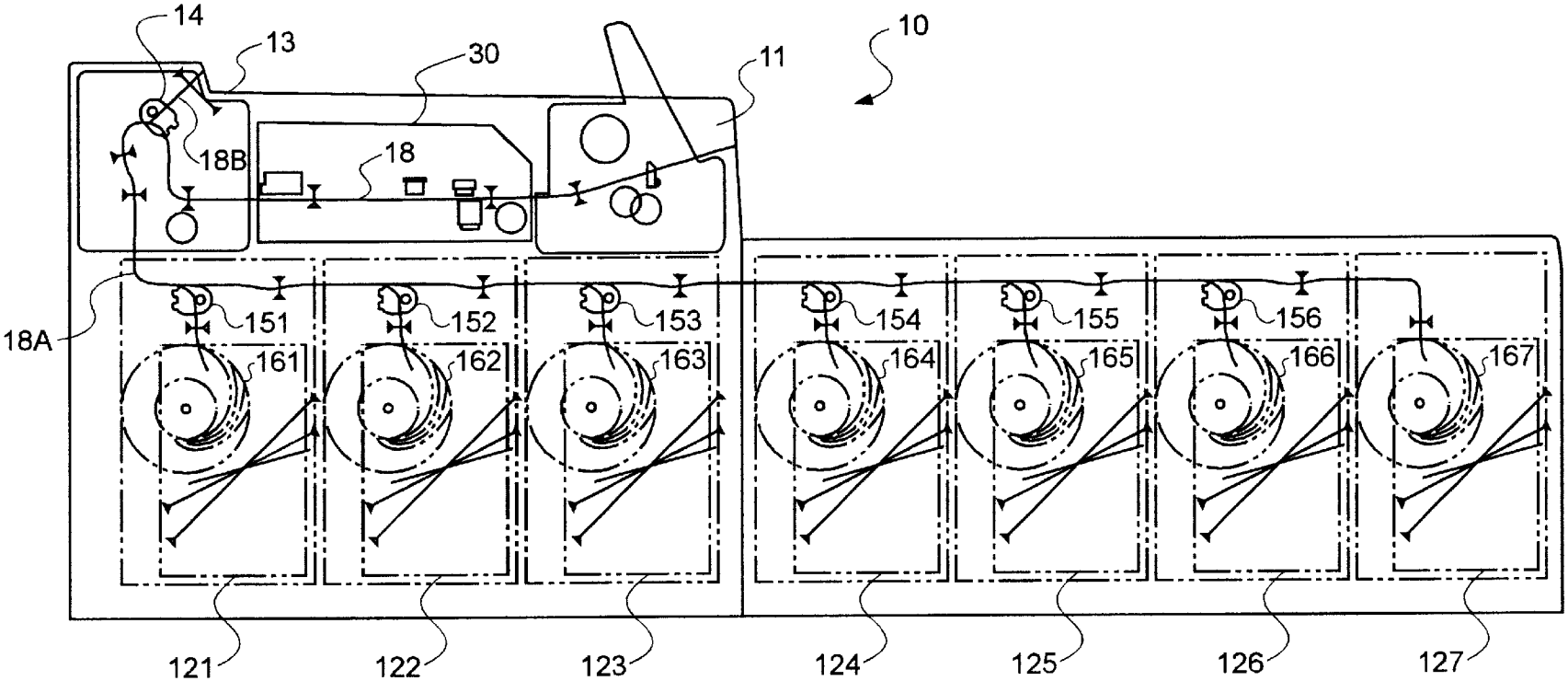
FIG. 3 is a sectional side view showing a structure of an embodiment of the bill receiving/processing machine according to the present invention.

FIG. 3 is a side view showing a sectional structure of the bill receiving/processing machine 10. A money denomination discriminating/counting means 30 is provided on a feed passage 18 between the hopper 11 and the reject stacker 13. The feed passage 18 of the reject stacker 13 is provided with a sorting plate 14 for sorting the fed bill to the feed passage 18A on the lower stackers 121 to 127 side or to the feed passage 18B to the reject stacker 13. The feed passage 18A on the upper portion of the stackers 121 to 127 is provided with sorting plates 151 to 156 corresponding to each of the stackers 121 to 127. These sorting plates 151 to 156 discharge the bill downwardly, and sort and collect it to each of the stackers 121 to 126. The stackers 121 to 127 are provided with impellers 161 to 167 for arranging and collecting the bill discharged from the upper feed passage 18A. The feed passages 18, 18A and 18B are provided with various sensors for optically sensing the passage of the bill.

Figure 4:
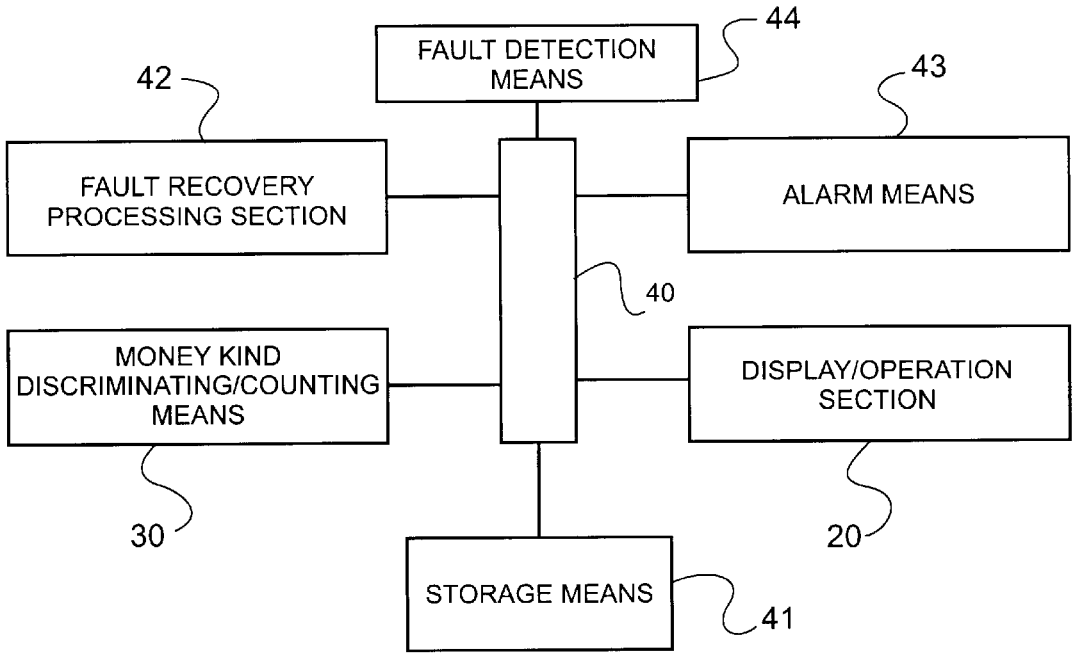
FIG. 4 is a block diagram showing an internal configuration example of the bill receiving/processing machine according to the present invention.

FIG. 4 shows an internal configuration of the bill receiving/processing machine 10. A control section 40 comprises a CPU for controlling the whole machine, and is connected with a storage means 41, the display/operation section 20 and the money denomination discriminating/counting means 30. Further, the control section 40 is connected to a fault recovery processing section 42, an alarm means 43 and a fault detection means 44 for detecting a fault such as a jam or the like.

The fault detection means 44 detects a fault generated in the money receipt transaction after the second time exclusion of the first time money receipt transaction, and then, operates the alarm means 43 via the control section 40 when detecting a generation of fault. The alarm means 43 rings a buzzer (not shown), visibly displays an alarm on the liquid crystal display section 21 of the display/operation section 20 and the LED display section 22, and flashes the display of the stacker LEDs 171 to 177. Further, the control section 40 controls the money denomination discriminating/counting means 30, and carries out money denomination discriminating and counting, and further, controls various sensors and signal processing. In addition, the control section 40 controls the sorting plates 14 and 151 to 156 and the impellers 161 to 167. The storage means 41 stores data such as the denomination and the number of bills of approved transaction.

Figure 5:
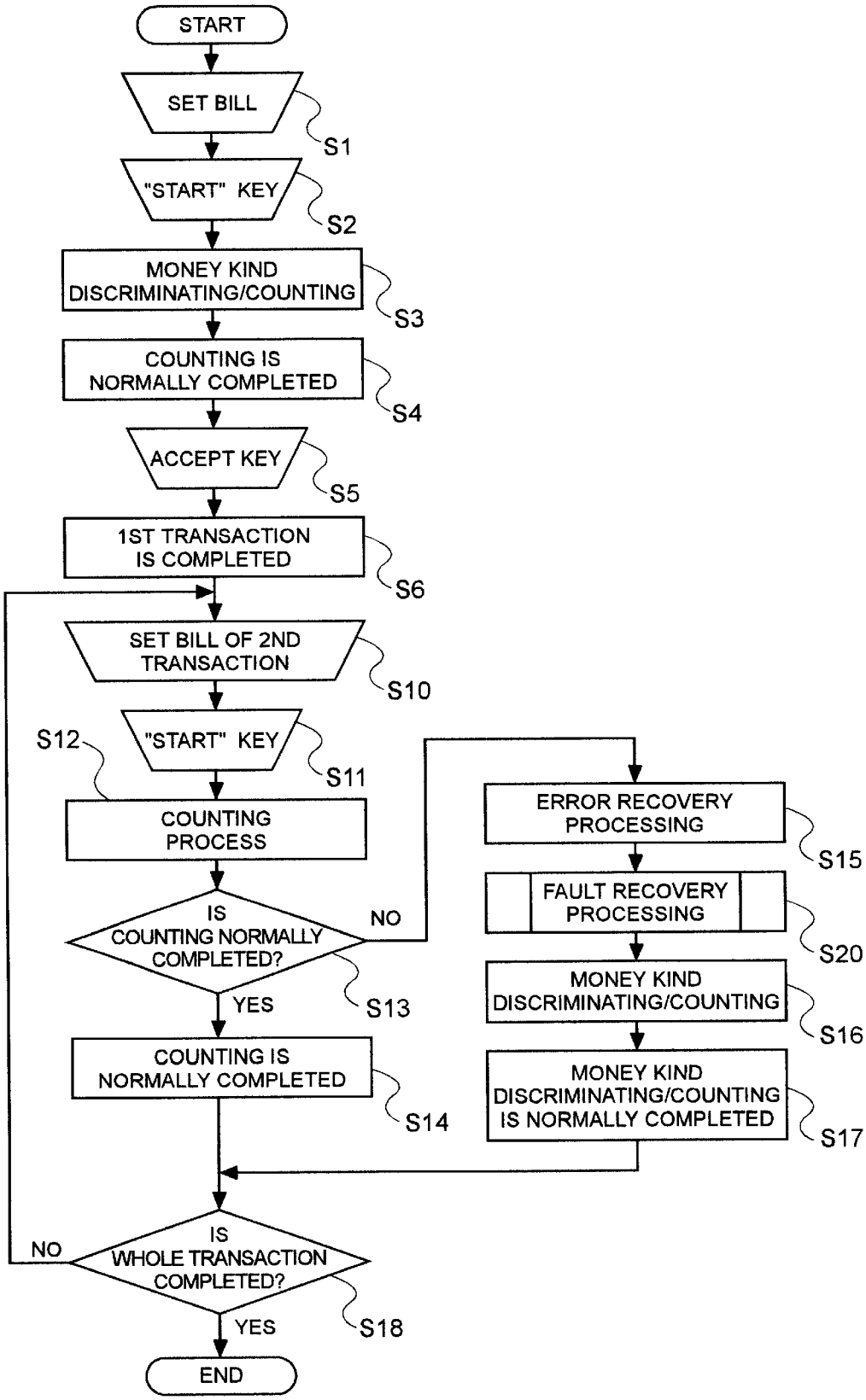
FIG. 5 is a flowchart showing an operation example according to the present invention.

With the above configuration, the operation will be described below with reference to a flowchart of FIG. 5.

First, a bill is set (placed) on the hopper 11 for each money receipt transaction (Step S1), and when depressing the "START/STOP" key 241 of the display/operation section 20 (Step S2), the bills placed on the hopper 11 are separated one by one, and then, each bill is fed to the inside along the feed passage 18. Further, the bill is fed to the money denomination discriminating/counting means 30 so as to be sorted and counted (Step S3). Then, when counting and money denomination discriminating are normally completed, the effect is displayed on the LED display 22 (Step S4), and the operator depresses the "ACCEPT" key 243 of the display/operation section 20 after confirming the display (Step S5), and thereby, the first time transaction is completed (Step S6). The operator collates the display of the display/operation section 20 and the stacker LEDs 171 to 177 with a statement slip relative to the money receipt transaction, and thereby, makes a decision whether or not money denomination discriminating/counting is normally carried out. When depressing the "ACCEPT" key 243, the money denomination discriminating/counting data is approved, and then, is stored in the storage means 41.

Likewise, a bill of the second time transaction is set (placed) on the hopper 11 (Step S10). In this step, the received bill of the previous transaction (first time transaction) is intactly received in the stackers 121 to 127. When depressing the. "START/STOP" key 241 of the display/operation section 20 (Step S11), the bill placed on the hopper 11 is fed to the money denomination discriminating/counting means 30 so as to be sorted and counted (Step S12). Subsequently, a decision is made whether or not counting and money denomination discriminating is normally completed by collating the data with the statement slip (Step S13). If the collation result is normal, the second time transaction is completed (Step S14), and thereafter, a decision is made whether or not the whole transaction is completed (Step S18). If the transaction is not completed, the sequence returns to the above Step S10 so that the above operation is repeated.

In the above Step S13, if a decision is made such the counting and money denomination discriminating is not normal, error recovery processing is carried out (Step S15), and subsequently, fault recovery processing is carried out (Step S20). The error recovery processing is completed by taking the bill out of the stackers 121 to 127, and depressing the "CLEAR" key 242 of the display/operation section 20. Thereafter, the same money denomination discriminating/counting as above is carried out (Step S16), and the sequence proceeds to the above Step S18 after money denomination discriminating/counting is normally completed.

Figure 6:
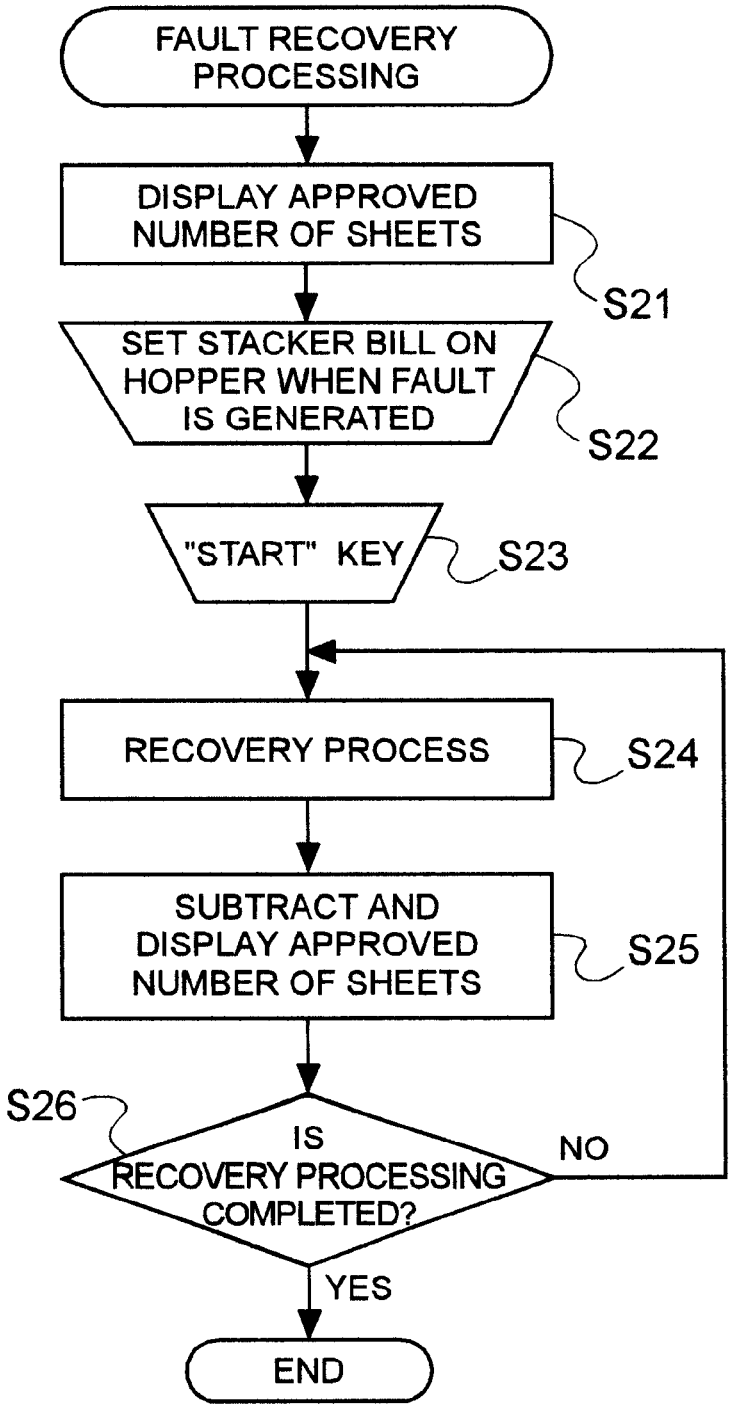
FIG. 6 is a flowchart showing an operation example of a fault recovery processing system according to the present invention.

FIG. 6 shows the details of fault recovery processing (Step S20). In the stacker LED5 171 to 177, the approved number of bills is displayed in a state of flashing (Step S21), and a bill is taken out of the stackers 121 to 127 when a fault is generated, and is collected, and thereafter, is set (placed) on the hopper 11 (Step S22). Then, when depressing the "START/STOP" key 241 of the display/operation section 20 (Step S23), money denomination discriminating/counting for recovery is carried out (Step S24), and when depressing the "ACCEPT" key 242, a discriminated bill is fed to the corresponding stacker. In this case, the approved number of bills of the stacker is subtracted, and the subtracted number is displayed on the stacker LEDs 171 to 177 (Step S25). Thereafter, the completion of the fault recovery processing is confirmed, and the control sequence ends (Step S26).

Figure 7:
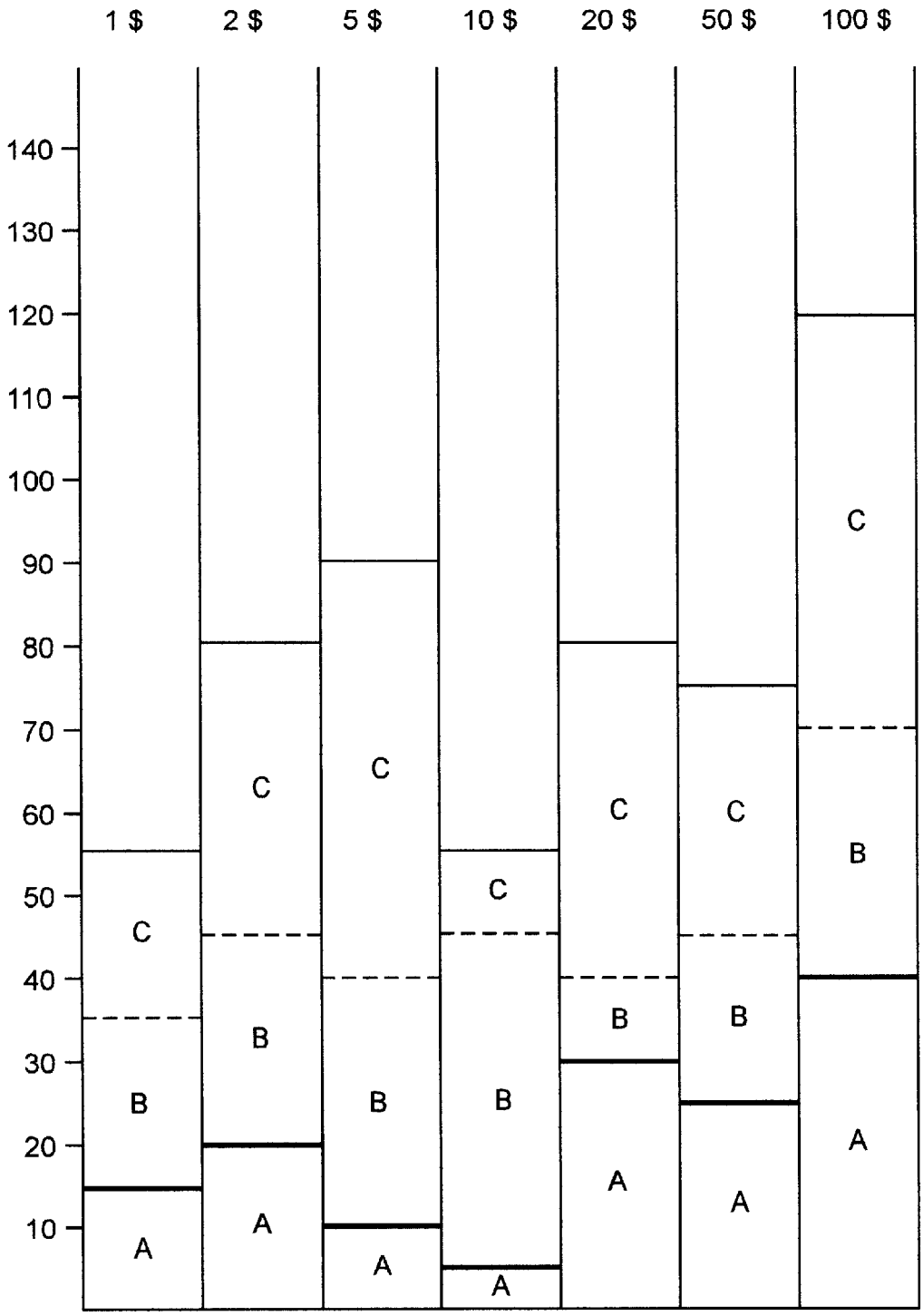
FIG. 7 is a view to explain fault recovery processing according to the present invention.

Next, the detailed fault recovery processing will be described below with reference to FIG. 7. In FIG. 7, the ordinate takes the number of bills, and the abscissa takes a money denomination (1$ bill to 100$ bill). In this embodiment, the following case is described. The bill receiving/processing machine 10 is arranged in a cash vault (cash center) of the bank X, and cash is sent to the cash vault from branches A to C of the bank X, and further, the cash (bill) thus sent is continuously processed. In this case, for convenience of explanation., processing is carried out in the order of the branches A to C; however the processing order may be arbitrary.

The cash sent from the branch A to the cash vault is attached with a statement slip describing the particulars for money denomination as shown in FIG. 8A. The bill is placed on the hopper 11 of the bill receiving/processing machine 10, and when depressing the "START/STOP" key 241 of the display/operation section 20, money receipt processing is started. The bills placed on the hopper 11 are all sorted into the stackers 121 to 127 for money denomination, and then, the number of counted (received) bills is displayed on the stacker LEDs 171 to 177 provided on the stackers 121 to 127. If the displayed number of bills and the particulars described in the statement slip coincide with each other in all money denomination, the operator depresses the "ACCEPT" key 243 so as to approve the count data. The approved count data is stored in the storage means 41. By doing so, the first time money receipt processing step is completed.

Next, the same money receipt processing as above is carried out as the second time transaction with respect to the bill sent from the branch B having the statement slip as shown in FIG. 8B. Finally, the same money receipt processing as above is carried out as the third time transaction with respect to the bill sent from the branch C having the statement slip as shown in FIG. 8C. This embodiment describes fault recovery processing in the case where a fault such as a jam is generated in the third time money receipt processing.

By the way, as shown in the statement slip of FIG. 8C, the received bill from the branch C is 235 bills in total; more specifically, 1$ bill: 20, 2$ bill: 35, 5$ bill: 50, 10$ bill: 10, 20$ bill: 40, 50$ bill: 30 and 100$ bill: 50. When processing the received bill of 235 bills, a jam is generated; therefore, part of the bills arereceived in the stackers 121 to 127, and the remainder are left in the hopper 11 or the feed passages 18 and 18A.

When the jam is generated, the generation of a jam is detected by the jam detection sensor as the fault detection means 44, and then, the information is given to the control section 40. Then, the control section 40 rings a buzzer so as to give an alarm for the generation of fault to the operator while displaying an error code on the liquid crystal display section 21 and " - - - " on the stacker LEDs 171 to 177 as an alarm output.

In the above manner, the generation of a jam is given as an alarm to the operator, and when the operator depresses the "CLEAR" key 242 of the display/operation section 20, the display of approved bills of the stacker LED corresponding to the stacker having the previously received bill changes from continuous lighting to flashing. The display changeover is carried out via the control section 40. In this embodiment, the bills of the branches A and B are received and approved, and received and approved bills exist in the stackers 121 to 127 of all money denominations. Therefore, the stacker LEDs 171 to 177 of all stackers 121 to 127 are flashing.

More specifically, the stacker LED 171 of the stacker 121 for 1$ bill makes a flashing display of 35 bills (=15 (branch A)+20 (branch B)). Likewise, in the stackers 122 to 127 after 2$ bill, the stacker LED172 for 2$ bill makes a flashing display of 45 bills, the stacker LED 173 for 5$ bill makes a flashing display of 40 bills, the stacker LED174 for 10$ bill makes a flashing display of 45 bills, the stacker LED175 for 20$ bill makes a flashing display of 40 bills, and the stacker LED176 for 50$ bill makes a flashing display of 45 bills, and the stacker LED177 for 100$ bill makes a flashing display of 70 bills, respectively. The operator, who has known the generation of fault by a buzzer sound or the like, takes all received bill out of the stackers 121 to 127 having a flashing display, and the bills remaining in the feed passages 18 and 18A due to the jam. Further, the operator takes the bills remaining in the hopper 11, and then, collects the billsand thereafter, again places them on the hopper 11. Thereafter, when the operator depresses the "START/STOP" key 241, fault recovery processing is started by the fault recovery processing section 42.

The fault recovery processing is carried out in the following manner.

The bill placed on the hopper 11 is discriminated in its money denomination while the number of bills being counted by the money denomination discriminating/counting means 30, and thereafter, is fed and received in the stackers 121 to 127 corresponding to the money denomination. In this case, even when the bill is fed to the stackers 121 to 127, a subtraction from the number of bills displayed on the stacker LEDs 171 to 177 is made, and thereafter, the number of bills is displayed. For example, the stacker LED for 1$ bill first makes a flashing display of "35," and the point of time when one 1$ bill is fed to the stacker 121, one is subtracted, "34" is displayed in a state of flashing. Every when the bill is fed and received in the stacker 121, the displayed number of bills is decreased in succession, and the display becomes "0" at the point of time when the transaction from the branches A and B is completed. When the transaction of the branch C is started, the number of bills is increased and displayed, and then, the stacker LED 171 for 1$ bill makes continuous lighting display; finally, the display of 1$ bill becomes "20."

In the above manner, the statement for money denomination of only money receipt transaction generating a fault is displayed on the stacker LEDs 171 to 177. The LED display section 22 displays the total number. Namely, without manually sorting the bills, it is possible to realize data selection relative to the money receipt transaction generating a fault.

Next, the following is a description on processing in the following case; more specifically, although no fault is generated, when receipt money processing of the branch C is carried out, the number of bills counted by the machine does not coincide with the number of bills described in the received money statement of the branch C. The reason why the number of bills does not coincide is considered as being a counting mistake by a person who is charge of making the received money statement. Coincidence is not obtained; for this reason, the bills of the transaction of the branch C are sorted and cancelled, and then, must be returned to the branch C. Although the bills of the branch C are mixed with the bills of the branches A and B already approved and received in the stacker, all of the bills I are taken out, and are placed on the hopper 11 after depressing the "CLEAR" key 242.

The storage means 41 stores the value adding of received and approved bills of the branches A and B, and thereby, the bills are received in the stackers 121 to 127 until it reaches the number of bills of "the branch A+ the branch "B" for money denomination. Thereafter, the sorting plate 14 is changed so that the bills after that are discharged to the reject stacker 13. In this manner, the bills of the branch C are sorted without manual work.

The above is a description on the case where a fault is generated and the transaction is canceled without generating a fault. The different control is carried out in the "CLEAR" key 242 operations after a fault is generated and when no fault is generated, although the control operation is the same, and therefore, this is one of features of the present invention. Further, the money denomination of the bill is seven; however, the number of money denominations may be arbitrarily set, and the stacker may be provided in accordance with the number of money denominations. As the above fault, bill jam is recited as an example. In this case, the discrimination and count mistake or the like are set as the fault.

As described above, according to the present invention, in the bill receiving/processing machine, when a fault is generated, the alarm of generation of fault is given to the operator, and the operator resets all bills on the hopper based on the given alarm, and thereby, it is possible to perform fault recovery processing. Therefore, no troublesome work is done. Further, the bill receiving/processing machine of the present invention includes no temporary reserving section; therefore, a cost reduction can be achieved. Furthermore, in the case where counting is completed in a money receipt transaction, and there is a difference between the number of counted bills and the number of declaration bills described in the received money statement, all bills are reset on the hopper, and thereby, the bill of money receipt the transaction is discharged to the reject stacker, so that canceling processing can be rationally made.

What is claimed is:

1. A bill receiving and processing machine, which separately feeds bills of transactions, placed on a hopper, one by one to a denomination discriminating and counting means, discriminates and counts the bills with said denomination discriminating and counting means, and sorts the bills, discriminated by said denomination discriminating and counting means, to a plurality of stackers through feed passages according to the denomination of said bills, said machine having no temporary reserving section for temporarily separating the bills from the plurality of stackers when the bills are received in the stackers for each denomination, said bill receiving and processing machine comprising:

a fault detection means for detecting a fault during a processing of a money receipt transaction B, said money receipt transaction B occurring subsequent to at least one or more money receipt transactions A;

an alarm means for producing an alarm when said fault is detected by said fault detection means; and a fault recovery processing section adapted to monitor the number of bills of each denomination associated with each said money receipt transaction and storing data relating to said number of bills, said fault recovery processing section, upon said alarm means producing said alarm, being configured to retrieve from the plurality of stackers, by bill denomination, the bills appertaining to said money receipt transaction B, together with the bills appertaining to money receipt transactions A, approved prior to the commencement of the processing of money receipt transaction B, said hopper being configured to receive said approved bills appertaining to money receipt transactions A and B, said fault recovery processing section being configured to differentiate the bills appertaining to money receipt transaction B from the bills of money receipt transactions A, which occurred prior to the processing of money receipt transaction B, received in said hopper, by utilizing the data of the bills of the money receipt transaction B and the data of the bills of money receipt transactions A, approved prior to the processing of money receipt transaction B.

2. A bill receiving and processing machine according to claim 1, wherein the bills returned to the hopper are the bills appertaining to money receipt transaction B when the fault is generated and bills already approved and received in the stackers before the processing of money receipt transaction B.

3. A bill receiving and processing machine according to claim 1, wherein a front panel is provided with a display and operation section, which visibly displays an alarm by said alarm means, and displays an operating instruction and a process of said fault recovery processing section.

4. A bill receiving and processing machine according to claim 1, wherein the stackers are respectively provided with stacker LEDs for displaying a number of received bills, wherein numerical displays of approved bills of the stacker LEDs are configured to change from a lighted display to a flashing display when said fault recovery processing section is operated, said LED's being further configured to display the subtracted number of the approved bills based on a re-counting of the bills returned to the hopper.

5. A bill receiving and processing machine according to claim 4, further including means of collecting bills received in said stackers, bills remaining in said feed passages of the machine and bills remaining in said hopper.

6. A bill receiving and processing machine according to claim 5, wherein the fault recovery processing section is configured such that when the number of bills displayed on the stacker LEDs based on a re-counting exceeds "0," a display of added bills is displayed to identify the number of bills of the transaction generating the fault.

7. A bill receiving and processing machine, which separately feeds bills of a transaction, placed on a hopper, one by one to a denomination discriminating and counting means, discriminates and counts the bills utilizing said denomination discriminating and counting means, and sorts the bills, discriminated by said denomination discriminating and counting means, through feed passages to a plurality of stackers according to denomination, said machine comprising a reject stacker for collecting rejected bills, independently from the plurality of stackers, said machine having no temporary reserving section for temporarily separating the bills from the plurality of stackers when the bills are received in the stackers for each denomination, and a control section configured for controlling said denomination discriminating and counting means, said control section being configured to detect a fault in the processing of a transaction by said denomination discriminating and counting means and cancel said processing such that when a plurality of money receipt transactions are consecutively carried out and a money receipt transaction B is canceled after an operation of said denomination discriminating and counting means is completed, said transaction B being a transaction which occurs subsequent to at least one or more prior money receipt transactions A, at least one of the bills of the money receipt transaction B being directed to the stackers by said denomination discriminating and counting means and approved bills appertaining to money receipt transactions A already being received in the stackers before the processing of money receipt transaction B, said control section being operative to collect said bills of said money receipt transactions A and B, thereby permitting an operator of said machine to manually return said bills of money receipt transactions A and B to said hopper, said control section being further configured to control an operation of said denomination discriminating and counting means subsequent to a return of said bills of transactions A and B to said hopper to direct the bills to the stackers consistent with the number of bills present in said stackers appertaining to the money receipt transactions approved before the money receipt transaction B was approved while discharging all bills in excess of said number to the reject stacker.

8. A bill receiving and processing machine according to claim 7, wherein a storage means and a display and operation section are provided, said storage means being adapted to store the number of bills appertaining to approved money receipt transactions, said display and operation section being configured to display an indication of said number of bills.

* * * * *